United States Patent [19]

Bassist

[11] 4,280,259

[45] Jul. 28, 1981

[54] METHOD OF KNITTING A VELOUR LACE FABRIC

[76] Inventor: Rudolph G. Bassist, 1003 McGran Blvd., Lancaster, Pa. 17601

[21] Appl. No.: 137,871

[22] Filed: Apr. 7, 1980

[51] Int. Cl.[3] ..... D06C 23/02

[52] U.S. Cl. ..... 28/160; 28/159; 66/202; 66/194

[58] Field of Search ..... 28/168, 160, 159; 66/202, 194

[56] References Cited

U.S. PATENT DOCUMENTS

| | | | |
|---|---|---|---|
| 1,980,191 | 11/1934 | Dickie et al. | 28/160 |
| 3,757,541 | 9/1973 | Frohlich | 66/202 |
| 3,848,556 | 11/1974 | Terada et al. | 66/202 |
| 4,096,610 | 6/1978 | Bassist | 28/159 |

FOREIGN PATENT DOCUMENTS

| | | | |
|---|---|---|---|
| 50-37789 | 12/1975 | Japan | 66/202 |
| 550525 | 1/1943 | United Kingdom | 28/159 |

*Primary Examiner*—Ronald Feldbaum
*Attorney, Agent, or Firm*—Alan H. Levine

[57] ABSTRACT

A knitted velour lace fabric is made by knitting a net or mesh ground fabric and knitting velour threads on to the ground fabric. Each velour thread substantially follows the path of one of the ground threads, except that at points along the length of the velour thread the latter is extended across a plurality of wales of the ground fabric to form an elongated loop. Stitches of soluble yarn are knitted on to the ground fabric to temporarily hold the elongated loops against one face of the ground fabric. Thereafter, the fabric is treated with a liquid or vapor to dissolve the soluble yarn and permit the velour loops to project outwardly from the face of the ground fabric. The velour loops may be of different lengths.

3 Claims, 3 Drawing Figures

METHOD OF KNITTING A VELOUR LACE FABRIC

This invention relates to knitting, and more particularly to a method of knitting a velour lace fabric. The invention involves a special case of the more general method illustrated and described in my U.S. Pat. No. 4,096,610.

Openwork fabrics, such as lace, are produced on warp knitting machines by knitting a ground fabric in which the paths of the ground threads are so arranged that certain wales are not connected together in every course. Openings in the ground fabric, making the ground fabric a net or mesh, occur at points where there are no side connections between adjacent wales, and the size of each opening depends upon the number of courses in which no lateral connections are present. When producing lace, pattern threads are knitted on to the net ground fabric, and in the case of a velour lace, some or all of the pattern threads are loops projecting from the ground fabric.

As pointed out in my earlier patent, conventionally, velour fabrics (including velour lace fabrics) have been knit in two ways. According to one method, a double bed knitting machine having two parallel, spaced apart needle bars is used. One of the needle bars carries a series of conventional knitting needles, upon which a ground fabric is knitted, and the other a series of straight pins about which the velour threads knitted into the ground fabric are looped to form the velour loops. Alternatively, both needle bars carry conventional knitting needles and the velour threads extending between the two needle bars are cut to leave a multiplicity of single high pile threads projecting from the ground fabric. The disadvantage of using a double needle bed machine is that it is expensive and does not operate as fast as a single needle bar machine.

The other conventional method involves using a single needle bar knitting machine and overfeeding velour threads to the needle bar so to form enlarged loops. However, a disadvantage of this method is that the velour thread often becomes tangled in the needles and guide bars and breaks.

It is an object of the present invention to overcome these problems by providing a method of knitting a velour lace fabric on a single needle bar machine and controlling the velour loops so as to positively prevent them from becoming tangled in the needles or guide bars.

It is another object of the invention to knit a velour lace fabric on a single needle bar machine in such a way that the enlarged velour loops are temporarily secured to a face of the ground fabric during the knitting operation so as to prevent them from accidently becoming tangled in any knitting machine parts, the velour loops being freed after the knitting operation has been completed.

A feature of the invention is the use of a soluble yarn for temporarily securing the velour loops to the ground fabric during knitting, the soluble yarn thereafter being dissolved to free the velour loops.

It is a further object of the invention to provide a method of making a knitted velour lace fabric in which the portions of each velour thread which are not used to form velour loops do not interfere with the openword ground fabric. This is accomplished by knitting each velour thread so that it substantially follows the path of one of the ground threads, i.e., that ground thread is effectively a double thread, except where the velour thread is extended laterally to form a loop.

In velour fabrics made conventionally on double needle bed machines, all the velour loops are necessarily of the same length determined by the distance between the two needle beds. It is an object of the present invention to provide a method of knitting a velour lace fabric wherein the velour loops may have different lengths if desired.

Additional objects and features of the invention will be apparent from the following description in which reference is made to the accompanying drawings.

Figure 1:
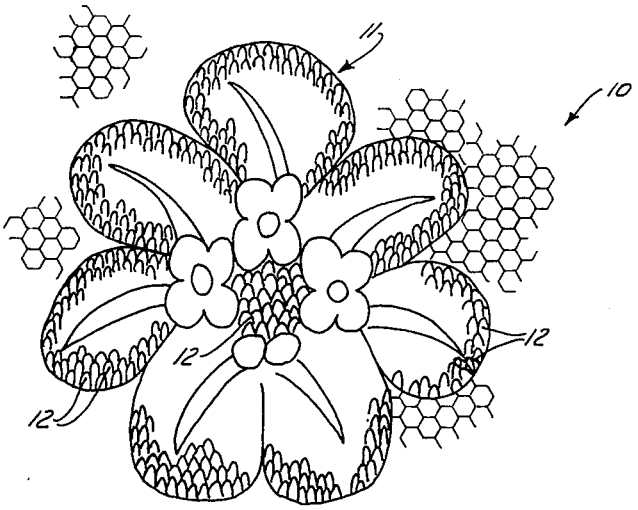
FIG. 1 is a face view of a velour lace fabric made according to the present invention.

A lace fabric comprises, as indicated in FIG. 1, a knitted net or mesh ground fabric 10 and additional pattern threads forming a design 11 carried by the ground fabric. Where at least some of the pattern threads from loops 12 projecting outwardly from a face of ground fabric 10, the fabric is a velour lace.

Figure 2:
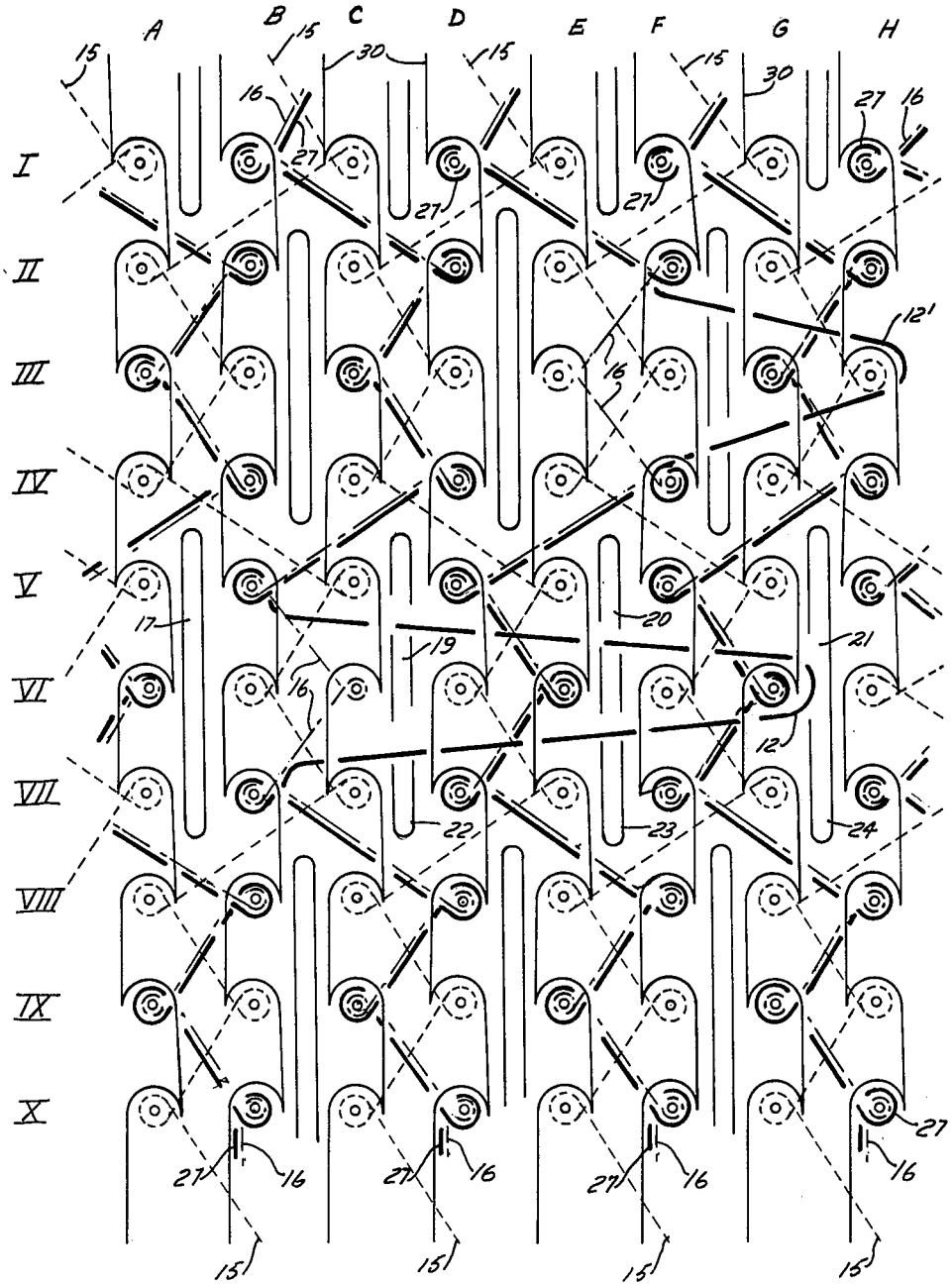
FIG. 2 is a schematic face view of a fabric being knitted according to the method of the present invention.

FIG. 2 illustrates the knitting operation according to this invention. In this example, the net ground fabric 10 is knit using two guide bars, one for ground threads 15, shown in dash lines, and one for ground threads 16, shown in dot-dash lines. At certain points, adjacent wales, i.e., vertical rows of stitches A-H, are not connected together for a few courses, i.e., horizontal rows of stitches I-X. For example, the wales A and B are unconnected at courses V, VI, and VII, thereby producing an opening 17 in the ground fabric, the opening being identified by the vertically elongated continuous line 18. Within the same courses V-VII, wales C and D, wales E and F, and wales G and H are unconnected, thereby defining openings 19, 20, and 21, respectively. These latter three openings are identified by vertically elongated lines 22, 23, and 24, respectively, which are shown discontinuous only to indicate that a velour loop, to be described below, overlies the opening as viewed in the drawing. Other similar openings in the ground fabric are indicated by elongated lines similar to the lines 18 and 22-24.

Using a separate guide bar or bars, velour threads 27 are knitted on to the ground fabric, the velour threads being shown in heavy solid lines broken only where other threads pass over them as viewed in FIG. 2. It will be seen that each velour thread 27, for part of its length, follows the path of one of the ground fabric threads, in this case thread 16. Thus, over a good portion of the ground fabric, one of the ground yarns is effectively a double thread 16, 27. During predetermined knitting cycles, a guide bar carrying a velour thread 27 is moved longitudinally to pull the velour thread across a plurality of wales of the ground fabric so as to form an elongated velour loop, i.e., a lay-in stitch, when the guide bar is moved longitudinally back to its original position. For example, in FIG. 2, velour loop 12 is shown extending laterally across five wales C-G of the ground fabric. By appropriate control of the velour thread guide bar or bars, in a known manner, velour loops in different locations on the ground fabric, and if desired of different lengths, can be produced. For example, another velour loop 12', shorter than loop 12, extends across only two wales G and H of the ground fabric. It will be understood that the velour thread in which loop 12' is formed is carried by a guide bar different from the guide bar carrying the velour thread in which loop 12 is formed.

The velour loops serve as pattern threads which either alone, or together with non-velour pattern threads, define the pattern portion 11 of the velour lace fabric. Although only two velour loops 12 and 12' are shown in FIG. 2 for illustration, as many velour loops as desired may be produced in order to achieve a particular pattern. Furthermore, the lengths of the velour loops may be varied by appropriate control of the velour thread guide bar or bars.

Using yet another guide bar, soluble yarns 30, shown in light solid lines in FIG. 2, are knitted into ground fabric 10 in such a way that yarns 30 attach velour loops 12, 12' to one face of the ground fabric, i.e., loops 12, 12' are formed between the ground fabric stitches and the stitches formed with yarn 30. As a result, during the knitting operation, elongated loops 12, 12' never have a chance to project outwardly from ground fabric 10 where they may get caught in the knitting needles or thread guides. Yarn 30 may be any type of known water-soluble yarn, such as those made of polyvinyl alcohol or sodium alginate, or a known yarn soluble in steam. The soluble yarn could also be of the known types soluble in various organic or inorganic solvents. For example, a cationic copolyester yarn, sold under the trademark Dacron Type 62, is soluble in caustic soda.

Figure 3:
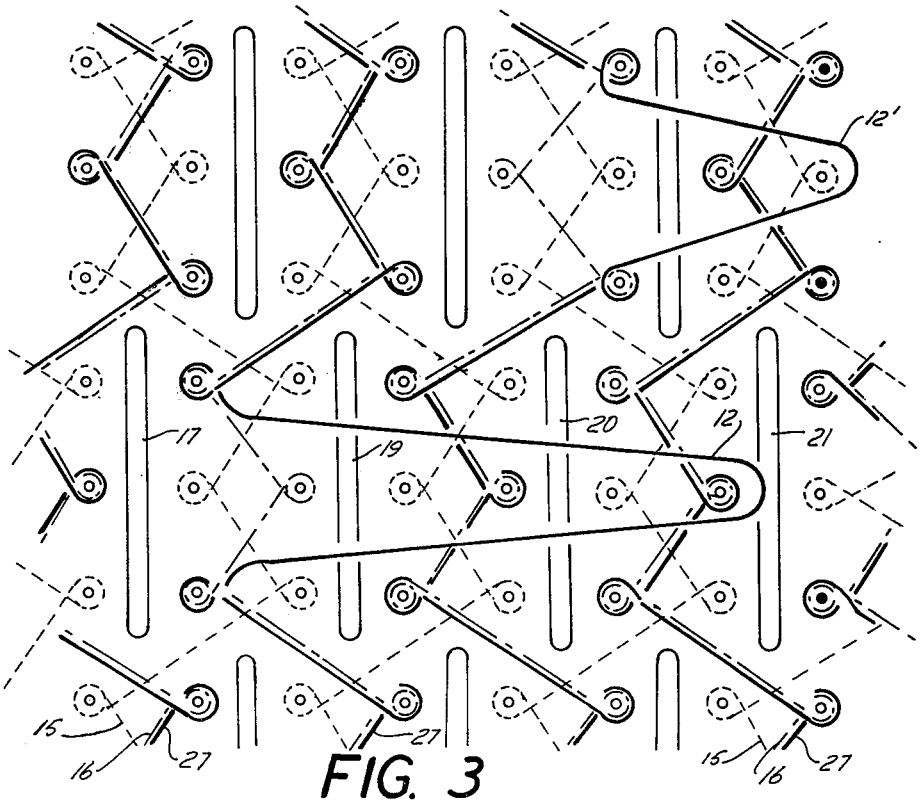
FIG. 3 is a schematic face view of the final velour fabric.

After the knitting operation described above has been completed, the fabric as shown in FIG. 2 is subjected to a treatment which dissolves soluble yarn 30, and leaves the fabric as shown schematically in FIG. 3. This treatment may involve washing in water, in the case of a water-soluble yarn, passing through a steam chamber in the case of steam-soluble yarn, or washing in a suitable solvent in the case of yarn soluble in such solvent. Once soluble yarn 30 disappears, velour loops 12, 12' spring away, or can be brushed away, from the face of ground fabric 10 to which they had been attached by yarn 30, so that the fabric appears as illustrated in FIG. 1.

The portions of the velour threads 27 which do not form loops 12 are actually knitted as part of the ground fabric 10 and hence remain fixed to the ground fabric even after soluble yarns 30 disappear. Furthermore, since each velour thread follows the path of one of the ground threads, those portions of the velour threads which do not form loops are not noticed and do not interfere with the mesh pattern of the ground fabric. It may be mentioned that to achieve certain effects, it may be desirable at particular points to knit the non-loop portion of the velour thread out of the path of its associated ground thread; for this reason, the invention contemplates that, except for the velour loops, each velour thread, if not completely following at least substantially follows the path of one of the ground threads.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A method of making a knitted velour lace fabric, comprising the steps of:

(a) knitting a net ground fabric having ground threads, (b) knitting velour threads on to the ground fabric such that each velour thread substantially follows the path of one of the ground threads except that at points along the length of the velour thread the latter is extended across a plurality of wales of the ground fabric to form an elongated loop, (c) knitting stitches of soluble yarn on to the ground fabric to temporarily hold the velour thread loops flat against one face of the ground fabric, and (d) thereafter treating the fabric with a liquid or vapor at a temperature and for a sufficient time to dissolve only the soluble yarn so as to free the velour thread loops to project outwardly from said face of the ground fabric, while leaving substantially all the non-looped remaining portion of each velour thread doubled with said one of the ground threads.

2. A method as defined in claim 1 wherein the velour loops are of different lengths.

3. A method as defined in claim 1 wherein knitting steps (a), (b) and (c) are performed simultaneously.

* * * * *